United States Patent [19]

Bedell

[11] Patent Number: 4,614,218

[45] Date of Patent: Sep. 30, 1986

[54] VACUUM BELT HUGGER FOR CASTING OF RIBBON

[75] Inventor: John R. Bedell, Madison, N.J.

[73] Assignee: Electric Power Research Institute, Palo Alto, Calif.

[21] Appl. No.: 471,995

[22] Filed: Mar. 4, 1983

[51] Int. Cl.[4] ..... B22D 11/06

[52] U.S. Cl. ..... 164/253; 164/423; 164/432

[58] Field of Search ..... 164/253, 474, 453, 431, 164/485, 443, 348, 463, 479, 481, 432, 433, 61, 423; 65/90, 101

[56] References Cited

U.S. PATENT DOCUMENTS

| | | | |
|---|---|---|---|
| 3,419,264 | 12/1968 | Gardner et al. . | |
| 3,426,836 | 2/1969 | Altenpohl et al. | 164/432 |
| 3,642,119 | 2/1972 | Warwick . | |
| 3,889,801 | 6/1975 | Boyer . | |
| 3,933,193 | 1/1976 | Baker et al. | 164/432 |
| 4,154,283 | 5/1979 | Ray et al. . | |
| 4,301,855 | 11/1981 | Suzuki et al. | 164/254 |

FOREIGN PATENT DOCUMENTS

| | | | |
|---|---|---|---|
| 0081848 | 6/1983 | European Pat. Off. | 164/432 |

*Primary Examiner*—Nicholas P. Godici
*Assistant Examiner*—J. Reed Batten, Jr.
*Attorney, Agent, or Firm*—King, Liles & Schickli

[57] ABSTRACT

A continuous casting assembly has a pair of contiguously counter-rotating belts for controllably forming a continuous cast metal ribbon. One of the belts is chilled and forms a casting surface for the cast ribbon, while the other belt is intimately positioned to hug the ribbon and improve the quality of the ribbon. The two belts are squeezed together to compress the ribbon by evacuating between the belts and allowing the atmospheric pressure to act on the opposite surfaces of the belts. A sealing box adjacent the lateral edges of the belts includes elongated floating seals and provides the evacuation by connection to a vacuum source. The floating seals are formed of plastic rods and are retained in the sealing box by end wiper seals which also serve to seal against the belts at the ends of the box.

10 Claims, 3 Drawing Figures

Fig. 2
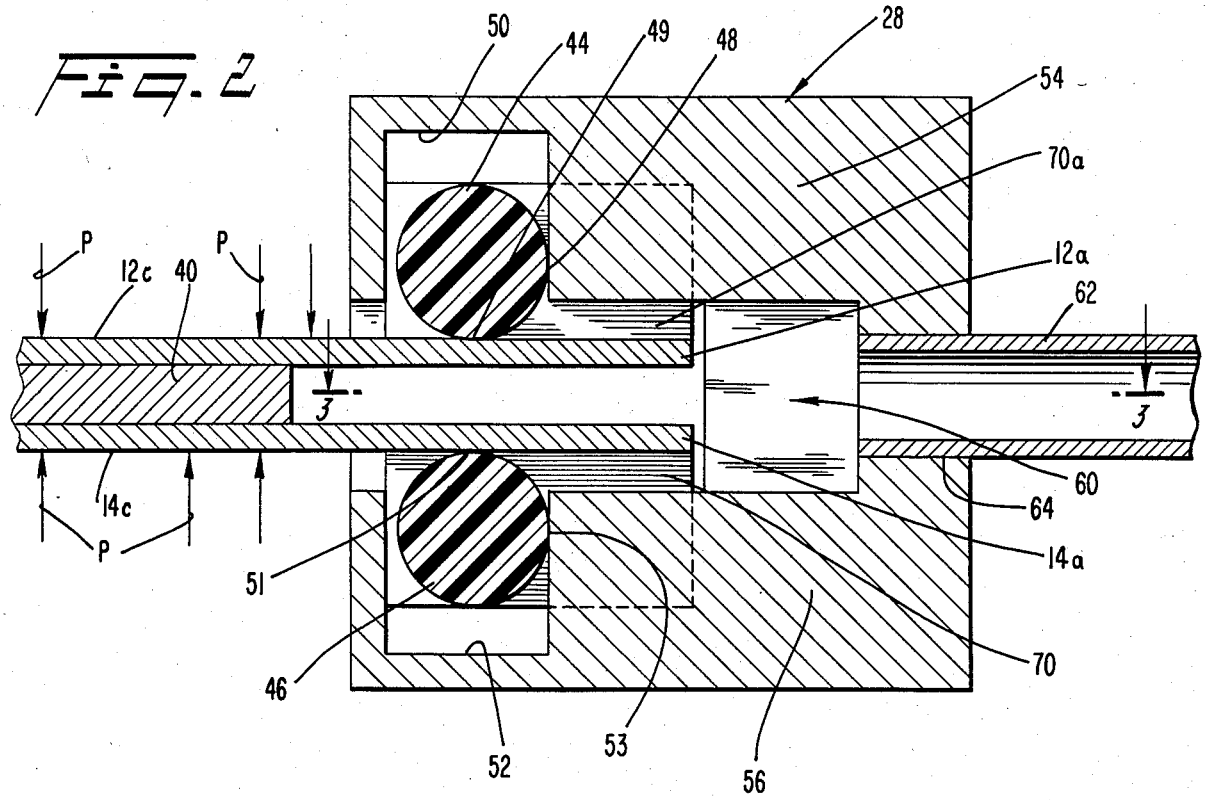
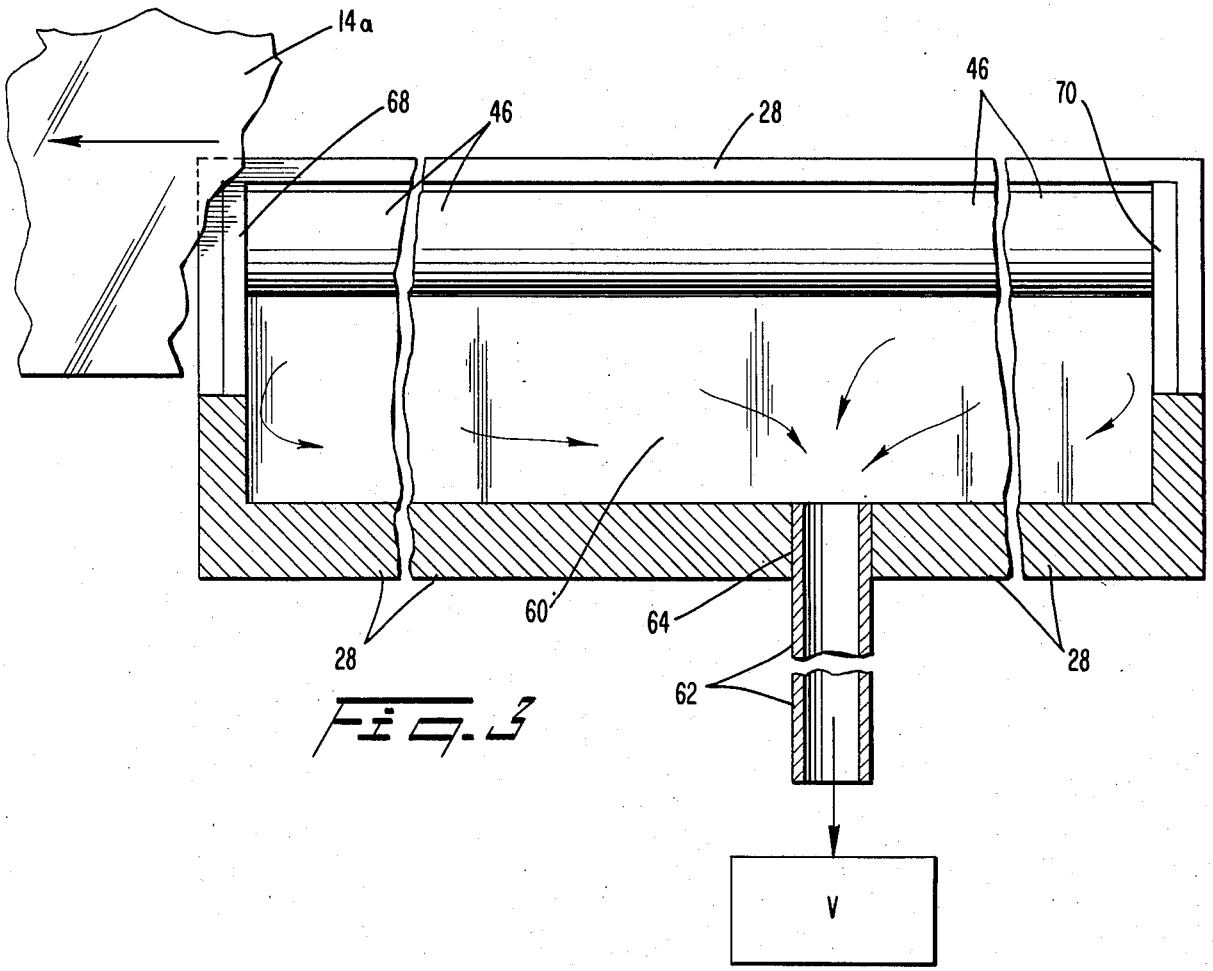
Fig. 3

VACUUM BELT HUGGER FOR CASTING OF RIBBON

TECHNICAL FIELD

The invention relates generally to casting continuous metal ribbon by depositing molten metal onto a moving chilled substrate. In particular, the invention relates to providing a chilled belt and a retention belt held together by evacuating between the belts and using the ambient air pressure to squeeze the cast molten metal ribbon between the belts for improved quality and control and enhanced heat transfer between the ribbon and belt members.

BACKGROUND OF THE INVENTION

In the process of continuously casting metal strips, such as ribbons, it is common practice to dispense molten metal through a nozzle onto a moving chilled substrate. The molten metal solidifies soon after contact with the chilled surface. If the cooling process is rapid enough, a cast product having an amorphous molecular structure is provided. This may be in the form of a relatively thin elongated strip or ribbon which has proven to be effective for winding into highly efficient cores for electrical transformers, and for other uses. Recent developments in the casting of amorphous metal strips are reviewed in U.S. Pat. No. 4,142,571.

It is known in the prior art to cast conventional metal alloys between a pair of opposed counter-rotating belts. In U.S. Pat. No. 3,426,836, for example, molten metal is deposited in a liquid state between a pair of upper and lower moving belts and a pair of lateral belts cooperatively forming a moving mold cavity. The molten metal is chilled in the mold cavity for solidification as it is moved with the cavity. Pressure is applied against the top and bottom belts to urge these belts against opposite sides of the interposed cast metal, the pressure being applied by either pressure rollers or a pressurized fluid, such as compressed air. The applied pressure is designed to compensate for shrinkage of the cast metal upon solidification. A further example of cooling molten metal between a pair of counter-rotating belts is shown and described in U.S. Pat. No. 2,285,740.

In U.S. Pat. No. 4,202,404, an apparatus for producing continuous metal strips on the peripheral surface of a rapidly rotating annular chill roll is disclosed. In this last mentioned patent, once the metal strip is deposited upon the chill roll, an elastomeric flexible belt frictionally engages an arcuate portion of at least 120° about the chill roll with the deposited metal strip positioned between the belt and the chill roll. The belt is wider than the cast strip so that it overlaps the marginal portions of the strip, and direct contact between the casting surface and the flexible belt is established immediately adjacent the portions of the strip. Flexible belts which engage the casting surface in this manner are known in the art as "hugger" belts.

It is also known in the art to use vacuum conveyor belts. The typical vacuum conveyor belt includes a perforated conveyor belt which is moved across a manifold. A vacuum is produced in the manifold and communicated through the perforations in the belt to secure objects on the surface of the belt opposite the manifold. In U.S. Pat. No. 3,642,119, for example, an endless vacuum conveyor belt is supported on its ends by circular pulleys with an elongated vacuum manifold of generally rectangular configuration between the pulleys. A line of perforations is provided in the belts and adapted to register with the slot in the vacuum manifold as the belt moves over the manifold. A similar type of configuration is shown in U.S. Pat. No. 3,889,801. A still further example of a vacuum belt is shown in U.S. Pat. No. 3,419,264.

It has recently been found that amorphous metals can be advantageously cast in a partial vacuum. In U.S. Pat. No. 4,154,283, molten amorphous metal is deposited in a vacuum chamber onto a rotatable chilled cylinder. The pressure in the vacuum chamber is no greater than 5.5 cm. Hg. and quenches the molten metal to form an amorphous metal alloy with reduced surface irregularities and improved tensile strength.

DISCLOSURE OF THE INVENTION

The present invention advances the teachings of the prior art by providing a casting system which utilizes the ambient atmospheric pressure to force a hugger belt into contacting relationship with a casting surface belt and a freshly cast metal ribbon interposed between the casting surface and the hugger belt. The ambient atmospheric pressure holds the belts together with a uniform force and may be used over an extensive length of the belts. The invention contemplates depositing a cast ribbon on the exterior surface of the casting surface belt and includes means for creating a partial vacuum between the contiguously disposed external surfaces of the casting surface and hugger belt. The pressure differential on opposite sides of the belts results in the application of a compressive force against the interior surfaces of the belt from the ambient atmospheric pressure. The freshly cast ribbon interposed between the exterior surfaces of the belts is squeezably retained by the belts for improved heat transfer between the belts and ribbon. Cast ribbon cooled in this manner has improved finish and shape.

One aspect of the invention contemplates that the contiguously counter-rotating belts with the interposed ribbon will continuously travel through a sealing chamber at the same speed, and that air will be withdrawn from the space between the exterior surfaces of the belts and the sealing chamber. The sealing chamber sealingly contacts the moving belts to pneumatically isolate the internal and external belt surfaces.

Accordingly, it is a primary object of the invention to use ambient atmospheric pressure to squeezably engage a pair of contiguously counter-rotating endless belts together for cooling of cast amorphous metal ribbons and the like by sandwiching the ribbon between the belts.

Another object of the invention is to squeezably engage a pair of contiguously counter-rotating endless belts togehter over an extensive length with uniform force and minimal expense to enhance the quenching of a freshly cast metal ribbon interposed between the belts and thereby improve the finish and shape, and to accurately control the position of the ribbon for delivering it to other systems.

Still other objects of the invention and advances in the teachings of the prior art by the present invention will become readily apparent to thosse skilled in the art from the following description. There is shown and described a preferred embodiment of the invention, simply by way of illustration of one of the best modes contemplated for carrying out the invention. As will be realized, the invention is capable of other different embodiments, and its several details are capable of modification in various, obvious respects all without departing from the invention. Accordingly, the drawings and descriptions that follow will be regarded as illustrative in nature and not as restrictive.

BRIEF DESCRIPTION OF THE DRAWINGS

The accompanying drawings incorporated in and forming a part of this specification, illustrate several aspects of the present invention, and together with the description serve to explain the principles of the invention. In the drawings:

FIG. 2 is a fragmentary cross-sectional view of one side of a sealing chamber used in the casting assembly of FIG. 1 taken along line 2—2 in FIG. 1 depicting a pair of sliding seals in contacting relationship with the pair of contiguously disposed counter-rotating belts for pneumatically isolating an area between the counter-rotating belts from the ambient atmosphere;

FIG. 3 is a sectional view of the sealing chamber of FIGS. 1 and 2 taken along line 3—3 in FIG. 2 and with the belt broken away for clarity.

Figure 1:
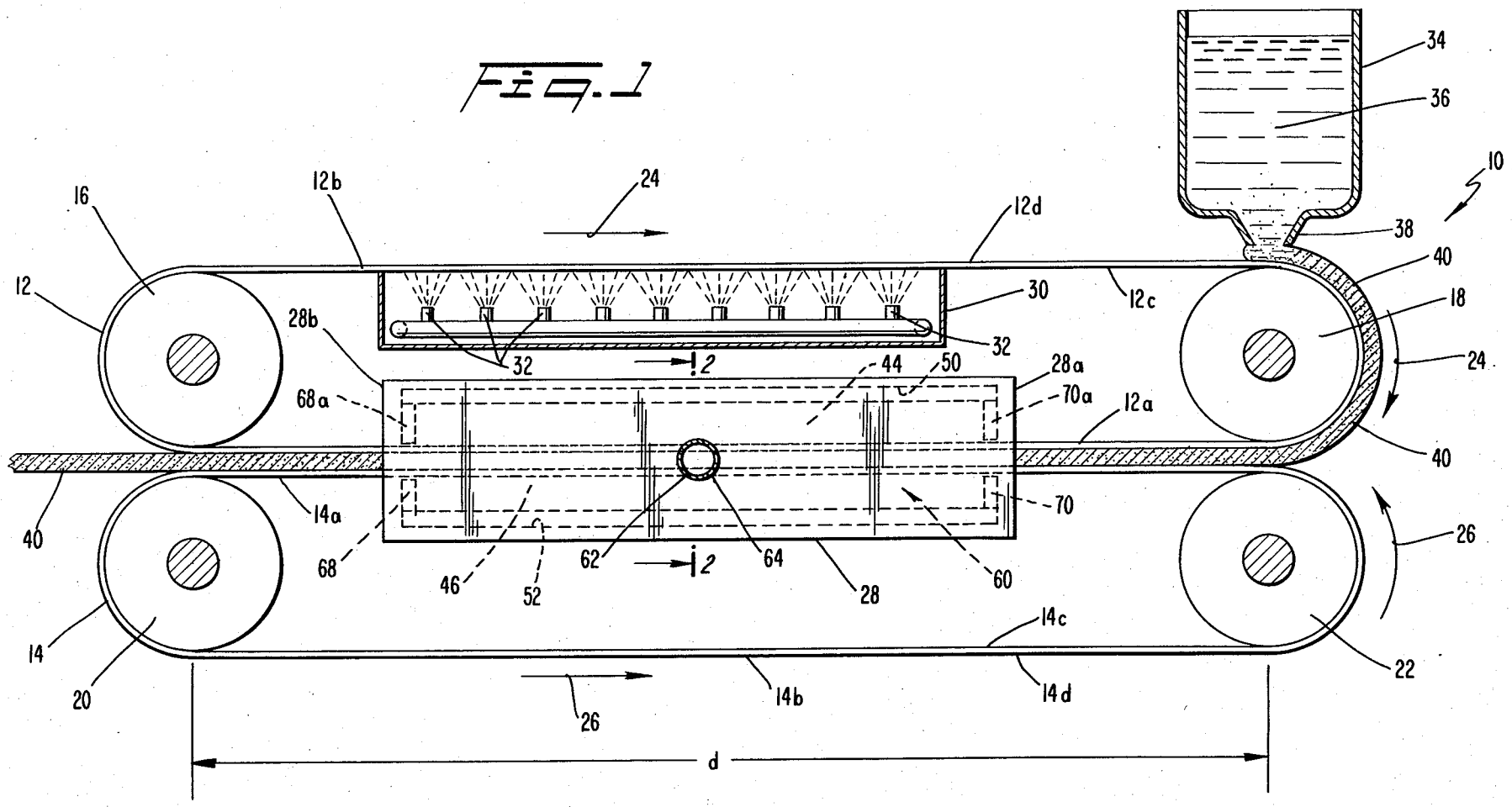
FIG. 1 is a schematic side elevational depiction of an assembly for continuously casting relatively thin elongated strips or ribbons of molten amorphous metal between a pair of contiguously disposed counter-rotating belts illustrating one form of the present invention.

Reference will now be made in detail to the present preferred embodiment of the invention, an example of which is illustrated in the accompanying drawings.

BEST MODE OF CARRYING OUT THE INVENTION

Reference is first made to FIG. 1 which schematically depicts a casting assembly 10 for casting a relatively thin elongated strip or ribbon of molten amorphous metal. The casting assembly 10 includes a pair of flexible contiguously disposed counter-rotating endless belts 12 and 14. The belt 12 extends between a pair of end rollers 16 and 18 to form a moving casting surface for receiving an elongated strip deposited thereon. The belt 14 extends between end rollers 20 and 22 and is termed a "hugger" belt since, as will be explained more fully below, it includes a portion that contacts or "hugs" a cooperating portion of the casting belt 12. In the illustrated embodiment of FIG. 1, end roller 16 is positioned vertically above end roller 20, and end roller 18 is positioned vertically above end roller 22 to position the hugger belt 14 in close parallel relationship to the casting belt 12.

The casting belt 12 includes a working portion **12*a* proximal to a cooperating working portion 14*a* of the counter-rotating hugger belt 14. Each of the belts 12, 14 is completed by a return portion, casting belt 12 having a return portion 12*b* and hugger belt 14 having a return portion 14*b*. Chilled belt 12 has an interior surface 12*c* and an exterior surface 12*d* while hugger belt 14 has interior and exterior surfaces 14*c* and 14*d* respectively. End rollers 16 and 18 contact the interior surface 12*c* of chilled belt 12, and end rollers 20 and 22 contact the interior surface 14*c* of hugger belt 14. As viewed in FIG. 1, the chilled belt 12 moves in a clockwise direction, as indicated by arrow 24, and hugger belt 14 moves in a counterclockwise direction, as indicated by arrow 26**.

The chilled and hugger belts 12 and 14 respectively, travel at the same linear speed with the respective working portions **12*a* and 14*a* traveling in closely spaced, substantially parallel paths for at least a predetermined distance (illustrated in FIG. 1 as distance d) between the respective end rollers 16, 18 and 20, 22. These substantially parallel paths are in close proximity so as to permit the belts 12 and 14** to compressingly engage an interposed molten strip as they travel in unison through this predetermined distance d.

A sealing box 28 is disposed about the respective working portions **12*a* and 14*a* of the belts 12, 14, within the predetermined distance d. The working portions 12*a* and 14*a* of these belts are advanced to enter the sealing box 28 through a first longitudinal end 28*a* and exit through the opposite longitudinal end 28*b*. The chilled belt 12 also has a cooling box 30 disposed about the return portion 12*b* to continuously chill the casting belt 12. As illustrated, the cooling box 30 includes a plurality of water jets 32 directing chilled water onto the interior surface 12*c* of the return belt portion 12*b*. As will be apparent hereinafter, the cooling of the chilled belt 12** expedites solidification of molten metal deposited thereon during the casting process.

A crucible 34 is disposed above the end roller 18. The crucible 34 contains an amorphous molten metal 36 which is discharged through a nozzle 38 intimately positioned above the chilled belt 12. As the molten metal 36 is discharged from the crucible 34, it is deposited onto the chilled belt's exterior surface **12*d*. After the molten metal 36 is deposited on the chilled belt 12, it quickly solidifies to form a continuous elongated strip or ribbon 40**.

As chilled belt 12 continues to move in the clockwise direction of arrow 24 in FIG. 1, the elongated ribbon 40 formed from the molten metal 36 is carried into a nip formed between end rollers 18 and 22. The hugger belt 14 begins to "hug" or forcibly contact the interposed ribbon 40 at this location, squeezably confining the ribbon 40 between the belts 12, 14. The endless belts 12 and 14, as noted above, travel at the same linear speed and continue in contacting relationship for the predetermined distance d along their substantially parallel paths. During their travel along the distance d, the belts 12, 14 pass through the sealing box 28. In a manner which will be explained in greater detail below, the air between the exterior surfaces of belts 12 and 14 is evacuated in the sealing box 28 to allow the atmospheric air pressure to apply a compressive engagement force against the interior surfaces **12*c* and 14*c* of belts 12 and 14 respectively to hold these belts in firm engagement with the interposed ribbon 40. Forcing the belts 12, 14 against the interposed ribbon 40 leads to better confinement and control of the ribbon 40. The ribbon 40 cast with the compressive force of the hugger belt 14 has a higher quality finish and is more uniform in thickness. Forcing the hugger belt 14 against the ribbon 40 also enhances the heat transfer between the ribbon 40 and the belts 12, 14** for more efficient cooling and solidification of the metal.

The relationship between the belt working portions **12*a* and 14*a* and the sealing chamber 28 is best illustrated in FIG. 2 which depicts one side of the sealing box 28. The edges of working portions 12*a*, 14*a* are shown in close parallel relationship with the interposed ribbon 40 sandwiched therebetween. The sealing box 28 has a pair of floating elongated linear seals 44 and 46 depicted in the preferred illustrated embodiment as rod configurations. However, as will be apparent to those skilled in the art, any number of geometrical configurations for the sliding seals 44 and 46 could be used within the spirit and scope of the present invention. The sliding seals 44 and 46 are ideally formed of plastic rods having a low coefficient of friction and having high wear resistance. In the preferred embodiment, tetrafluoroethylene has been selected as the sliding seal material. Sliding seal 44 is in contacting relationship with the top (as shown in FIG. 2) or interior surface 12***c* of the chilled belt's working portion 12*a*, and linear seal 46 is in contacting relationship with the interior or bottom (as shown in FIG. 2) surface 14*c* of the hugger belt's working portion 14*a*. The seals 44, 46 are contained within elongated open box-like recesses 50 and 52 defined by upper and lower legs 54 and 56 of the sealing box 28. These upper and lower sealing chamber legs are integrally joined by a connecting section.

An interior vacuum chamber 60 is formed in the sealing box 28 by the upper and the opposed, lower legs 54, 56. An air conduit 62 extends through an aperture 64 in connecting section to put the vacuum chamber 60 into fluid communication with a vacuum source V (as shown in FIG. 3). The vacuum source V of the system may take the form of a vacuum pump or any of several other conventional apparatus for evacuating air. As noted above, FIG. 2 depicts only one side of the sealing Chamber 28. The opposite side is a virtual mirror image of the illustrated side.

The sliding seals 44 and 46 are movable upwardly and downwardly (perpendicular to the direction of belt movement) within the recesses 50 and 52 into and out of the vacuum chamber 60. The sides of belt working portions 12*a* and 14*a* also extend into the chamber 60 between the sliding seals 44 and 46. When air is evacuated through air conduit 62, the resulting partial vacuum within vacuum chamber 60 urges the seals 44 and 46 into the chamber 60 toward the external vacuum source. This movement of the seals 44 and 46 into the chamber 60 is limited by the interior belt surfaces 12*c* and 14*c*. As a result, the seals 44 and 46 are sealingly urged against the belts 12 and 14 along sealing contact lines 49 and 51 respectively. The partial vacuum within chamber 60 also urges the seals 44 and 46 against the interior walls of recesses 50 and 52 along sealing contact lines 48 and 53 respectively. The sealing engagement of seals 44 and 46 against the interior surfaces 12*c* and 14*c* also places upper limits on the application of vacuum to the area between the exterior belt surfaces 12*d*, 14*d* of the belts. The movability of the seals 44 and 46 within the recesses 50 and 52 allows them to maintain their sealing relationship as they wear and further enables them to accommodate relative movement between the belts 12, 14 and the legs 54, 56.

The creation of a partial vacuum between the belts 12 and 14 results in a disparity in the pressure acting against the interior 12*c*, 14*c* and exterior 12*d*, 14*d* surfaces of the belts with the result that the ambient atmospheric pressure compressively urges the belts 12, 14 together. The differential pressure acting against the belts 12, 14 is schematically illustrated in FIG. 2 by a plurality of arrows P. As mentioned above, the ribbon 40 is interposed between the belts 12 and 14. Thus, the ambient atmospheric pressure P forces the belts 12 and 14 together with the ribbon 40 sandwiched therebetween. Forcing the traveling belts 12 and 14 together in this manner through the generation of a vacuum in a sealing chamber permits forced contact between the belts over an extensive length with substantial cost savings over other means of forcibly holding the moving belts together.

Since the sliding seals 44, 46 are urged into forcible sealing contact with the traveling belts 12, 14, the belts 12, 14 tend to move the seals 44, 46 in the direction of belt travel. As depicted most clearly in FIG. 1, end wiper seals 68, 68*a*, and 70, 70*a* are transversely mounted adjacent the recesses 52 and 50 to seal the ends and limit movement of the seals 44, 46. The downstream end seals 68, 68*a* are compressed since the belts 12, 14 are always moved in the directions illustrated. However, both sets of the end seals 68, 68*a* and 70, 70*a* serve to pneumatically isolate the chamber 60 from the ambient atmosphere.

Preferably, the end seals 68, 68*a* and 70, 70*a* are attached to the ends of the respective sliding seals to float therewith and wipe the belts 12, 14 during operation. Alternatively, the end seals may float separately with springs in the recesses 50,52 urging the seals toward the belts 12,14. All of the seals 44, 46, 68,68*a*,70,70*a* are preferably fabricated of material having substantially the same wear properties.

The sectional and longitudinal dimensions of the seals 44, 46 inherently limit the pneumatic forces which can be exerted by the pressure differential between the ambient atmosphere and vacuum chamber 60. Thus, greater or lesser sealing force at the sealing contact lines 49 and 51 may be controlled by judicious determination of the seal dimensions.

In summary, numerous benefits have been described from employing the concepts of the invention. The invention permits two contiguously traveling belts 12, 14 to be forced together over an extensive length by the anbient atmospheric pressure to controllably sandwich a freshly cast metal ribbon 40 therebetween. Forcibly sandwiching the ribbon between the belts in this manner enhances the quenching of the ribbon through improved heat transfer between the belts and the interposed ribbon. The invention also results in improved finish or shaping of the interposed ribbon 40 and improved control over its position relative to the belts for improved delivery of the ribbon from the belts to winding and measurement systems. The use of the ambient air pressure to force contact of the two contiguous belts permits the interposed ribbon to be squeezed over an extensive length with substantial cost savings over equivalent equipment.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to illustrate the principles of the invention and its practical application to enable one of ordinary skill in the art to utilize the invention and the various embodiments and with various modifications as they are best suited to the particular use contemplated. It is intended that the scope of the invention be defined by the claims as appended hereto.

I claim:

1. In an assembly for casting continuous metal ribbon, an apparatus for controllably cooling the ribbon, comprising:

(a) a continuously moving chilled belt traveling at a predetermined speed, said chilled belt including an external surface for receiving molten metal;

(b) means for depositing a molten metal ribbon onto the external surface of the chilled belt;

(c) a continuously counter-rotating hugger belt disposed adjacent the external surface of the chilled belt, said hugger belt including an external control surface traveling a predetermined distance in substantially parallel relationship to said external surface of said chilled belt at said predetermined speed; and (d) means for creating a partial vacuum between external surfaces of the chilled and hugger belts along at least a portion of the predetermined distance and allowing the ambient pressure along the interior surfaces of the belts to urge the belts together with the ribbon interposed therebetween to control the ribbon and enhance heat transfer relationship between the ribbon and the belts.

2. An apparatus as recited in claim 1 wherein said vacuum creating means includes a sealing chamber, said chilled and hugger belts traveling through said sealing chamber along said predetermined distance.

3. An apparatus as recited in claim 2 wherein the sealing chamber further includes a plurality of seals in sealing relationship with the internal surfaces of the belts.

4. An apparatus as recited in claim 3 wherein said plurality of seals pneumatically isolate the external sides of the belts from the ambient atmospheric pressure.

5. An apparatus as recited in claim 4 wherein said seals are movable within said sealing chamber toward and away from said belts to accommodate wear of the seals and movement of the belts.

6. An apparatus as recited in claim 5 wherein both sides of the belts are disposed in vacuum chambers pneumatically isolated from the internal surfaces of the belts.

7. An apparatus as recited in claim 6 wherein each of said sealing chambers includes a pair of oppositely disposed recesses and said sliding seals are at least partially disposed within said recess.

8. An apparatus as recited in claim 7 including means for limiting movement of said sliding seals in the direction of belt travel.

9. An apparatus as recited in claim 8 wherein said sealing chamber includes end seals at opposite ends of the chamber to pneumatically isolate the vacuum chambers from the ambient atmospheric pressure.

10. An apparatus for controllably cooling cast molten metal ribbon, comprising:

(a) a first endless belt, including a first external working surface moving at a predetermined speed;

(b) a second endless belt, said second belt being contiguously counter-rotating with respect to said first belt including a second external working surface moving at the same predetermined speed in substantially parallel relationship adjacent to said first working surface;

(c) means for introducing a molten metal ribbon between the working surfaces of the first and second belts; and (d) means for creating a partial vacuum between the working surfaces of the belts and permitting the ambient air pressure on the interior surfaces of the belts opposite the working surfaces to urge the working surfaces toward each other into squeezing relationship to compress the ribbon between the working surfaces to control the ribbon and enhance the heat transfer relationship between the ribbon and the belts.

* * * * *